US006825600B2

(12) United States Patent
Shin et al.

(10) Patent No.: US 6,825,600 B2
(45) Date of Patent: Nov. 30, 2004

(54) COLOR SELECTION APPARATUS FOR CATHODE RAY TUBE HAVING REAL AND DUMMY BRIDGES

(75) Inventors: Soon-Cheol Shin, Suwon (KR); Jong-Han Rhee, Suwon (KR); Sang-Ho Jeon, Seonganam (KR); Jun-Jong Lee, Seoul (KR); Hyang-Jin Koh, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 52 days.

(21) Appl. No.: 10/155,370

(22) Filed: May 23, 2002

(65) Prior Publication Data

US 2002/0185952 A1 Dec. 12, 2002

(30) Foreign Application Priority Data

Jun. 8, 2001 (KR) ..... 2001-32193

(51) Int. Cl.[7] ..... H01J 29/80
(52) U.S. Cl. ..... 313/407; 313/402; 313/403
(58) Field of Search ..... 313/402, 403, 313/404, 407, 408

(56) References Cited

U.S. PATENT DOCUMENTS 3,638,063 A 1/1972 Tachikawa et al.
4,926,089 A 5/1990 Moore
4,942,332 A 7/1990 Adler et al.
4,973,283 A 11/1990 Adler et al.
6,388,370 B1 * 5/2002 Ohmae ..... 313/403
6,437,496 B1 * 8/2002 Kim et al. ..... 313/402
6,548,950 B2 * 4/2003 Kobayashi et al. ..... 313/403
6,614,154 B2 * 9/2003 Shin et al. ..... 313/403
2002/0005688 A1 * 1/2002 Bae et al. ..... 313/402

* cited by examiner

*Primary Examiner*—Joseph Williams
*Assistant Examiner*—Kevin Quarterman
(74) *Attorney, Agent, or Firm*—Christie, Parker and Hale, LLP

(57) ABSTRACT

A color selection apparatus for a cathode ray tube. A mask is formed having a long axis and a short axis. A frame supports the mask in one of a long axis direction and a short axis direction. The mask has a plurality of strips separated by a predetermined distance. A plurality of first beam apertures are formed as single long slits between the strips in a center portion of the mask. A plurality of second beam apertures are formed on outer portions of the mask to both sides of the center portion of the mask. The second beam apertures are divided into a plurality of individual units within a single column by real bridges and at least one dummy bridge for each individual second beam aperture unit. The at least on dummy bridge extends inwardly from the strips but does not cross completely through the individual second beam aperture unit.

8 Claims, 4 Drawing Sheets

COLOR SELECTION APPARATUS FOR CATHODE RAY TUBE HAVING REAL AND DUMMY BRIDGES

CROSS-REFERENCE TO RELATED APPLICATIONS

This application claims priority to and the benefit of Korean Application No. 2001-32193, field on Jun. 8, 2001 in the Korean Patent Office, the entire disclosure of which is incorporated herein by reference.

FIELD OF THE INVENTION

The present invention relates to a cathode ray tube having a panel, on which a phosphor screen is formed, that is made flatter and increased in size, and more particularly, to a color selection apparatus for such a cathode ray tube.

BACKGROUND OF THE INVENTION

Cathode ray tubes (CRTs) are the most widely used type of display device. The CRT has undergone many improvements over the years, but in recent times, much attention has been given to making the CRT flatter, that is, to making a surface of a panel on which a screen is formed flatter. A flatter panel improves picture quality. Also, there have been efforts to increase CRT screen size (i.e., to increase a size of the panel) in order to satisfy consumer demand for larger display sizes for televisions, computer monitors, etc.

With the flattening and increasing in size of the panel, it is necessary to increase a size of a shadow mask, which is part of a color selection apparatus used to realize colors in the CRT. Because of problems associated with increasing the size of the shadow mask, such as a decrease in strength, many manufacturers apply a new type of color selecting apparatus to their CRTs.

In one such CRT color selecting apparatus, a mask which has a plurality of apertures through which electron beams pass is not curved as in conventional CRTs, but is flat such that a predetermined tension can be applied to the mask. U.S. Pat. No. 3,638,063 discloses a color selecting apparatus having an aperture grill-type mask. The aperture grill mask is made from a plurality of strips that are separated by a predetermined distance and supported by a frame in such a manner as to apply tension in a single direction. Thermal expansion occurring during operation of the CRT is absorbed by a tension applied during mounting of the strips. As a result, the problem of doming common in typical shadow masks is prevented.

However, since the strips forming the aperture grill mask are at a minimal thickness of approximately 0.1 mm, and are connected only at their ends to the frame and with no interconnection between the strips, the strips easily vibrate even with the application of a small external impact. U.S. Pat. Nos. 4,926,089, 4,973,283, and 4,942,332 disclose structures in an attempt to eliminate this problem.

In particular, the above-referenced patents disclose masks that are mounted receiving a predetermined degree of tension on a support assembly, and that include a plurality of strips that are separated by slits and coupled by real ties. Also, false ties are formed between the real ties to minimize the visibility of real tie shadows on the screen. This structure will be described in more detail with reference to FIG. 4.

As shown in the drawing, mask 1 mounted in tension on a support assembly (not shown) includes a plurality of strips 3 that are provided in a direction (shown by arrow 'y') and at a predetermined pitch (i.e., a center-to-center spacing) with real ties 5 arranged between strips 3, extending in a horizontal direction (shown by arrow 'x') and at a predetermined pitch, to form slits 7. Also, a plurality of false ties 9 are formed in each of slits 7, false ties 9 extending in the same direction as real ties 5 but not interconnecting adjacent strips 3.

However, during actual operation of the CRT using the above mask structure, shadows of real ties 5 form black lines on the screen. That is, when electron beams are passed through slits 7 of mask 1, electron beams striking real ties 5 cause shadows of real ties 5 to be formed on the screen of the CRT. Since real ties 5 are formed along lines in the horizontal direction (x), black lines are formed on the screen. This significantly reduces picture quality. The present invention has been made in an effort to solve the above problems.

SUMMARY OF THE INVENTION

In accordance with the present invention a color selection apparatus for a cathode ray tube is provided that minimizes black lines formed on a phosphor screen, that limits the ability to perceive the black lines to thereby improve picture quality, and which is resistant to vibration as a result of external impact.

A color selection apparatus is provided including a mask formed having a long axis and a short axis, and a frame supporting the mask in one of a long axis direction and a short axis direction. The mask includes a plurality of strips separated by a predetermined distance. A plurality of first beam apertures are as single long slits between the strips in a center portion of the mask. A plurality of second beam apertures are formed on outer portions of the mask on both sides of the center portion of the mask. The second beam apertures are divided into a plurality of individual units within a single column by real bridges and at least one dummy bridge for each individual second beam aperture unit. The dummy bridges extend inwardly from the strips but do not cross completely through the individual second beam aperture units.

According to a feature of the present invention, a tension T, applied to the strips in the area of the mask where the first beam apertures are formed is greater than a tension $T_2$ applied to the strips in the area of the mask where the second beam apertures are formed.

According to another feature of the present invention, the tensions T, and $T_2$ satisfy the following condition:

$$T_2 < T_1 \leqq 2T_2$$

According to yet another feature of the present invention, a number of real bridges formed between the second beam apertures in a single column is increased as a distance from the center portion of the mask is increased.

According to still yet another feature of the present invention, a real bridge height Rhw and a dummy bridge height Dhw (both in a direction of the short axis of the mask) satisfy the following condition:

$$0.5Rhw \leqq Dhw \leqq 2.0Rhw$$

According to still yet another feature of the present invention, the dummy bridges are formed from the strips in a direction of the long axis of the mask.

According to still yet another feature of the present invention, the dummy bridges formed on one side of the second beam apertures correspond to the dummy bridges formed on an opposite side of the second beam apertures.

BRIEF DESCRIPTION OF THE DRAWINGS

The accompanying drawings, which are incorporated in and constitute a part of the specification, illustrate an embodiment of the invention, and, together with the description, serve to explain the principles of the invention, wherein.

DETAILED DESCRIPTION OF THE INVENTION

Figure 1:
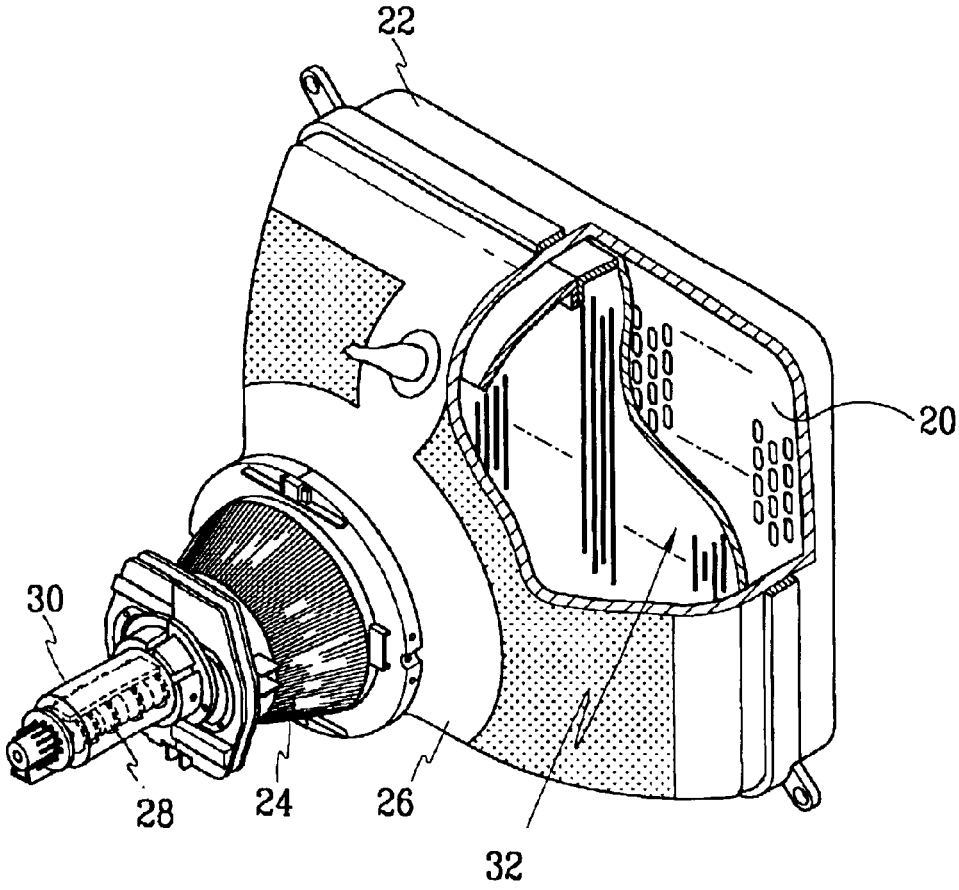
FIG. 1 is a partially cutaway perspective view of a cathode ray tube using a color selection apparatus according to an embodiment of the present invention.

Embodiments of the present invention will now be described in detail with reference to the accompanying drawings, wherein:

FIG. 1 is a partially cutaway perspective view of a cathode ray tube using a color selection apparatus according to an embodiment of the present invention.

An exterior bulb made of glass defines the bulk of an exterior of a cathode ray tube (CRT). The exterior bulb includes panel 22, funnel 26, and neck 30, which are fused to form the exterior bulb. Phosphor screen 20 is formed to an inside surface of panel 22. Also, deflection unit 24 is mounted at a predetermined position with respect to an outer circumference of funnel 26. Mounted within neck 30 is an electron gun 28, which emits R, G, B electron beams toward phosphor screen 20.

Panel 22 includes an exterior front surface that is formed to be flat, and an interior front surface that is curved having a curvature radius. Color selection apparatus 32 applied to the CRT, as in conventional configurations, is mounted to the inside of panel 22 and performs color separation of the electron beams emitted from electron gun 28.

Figure 2:
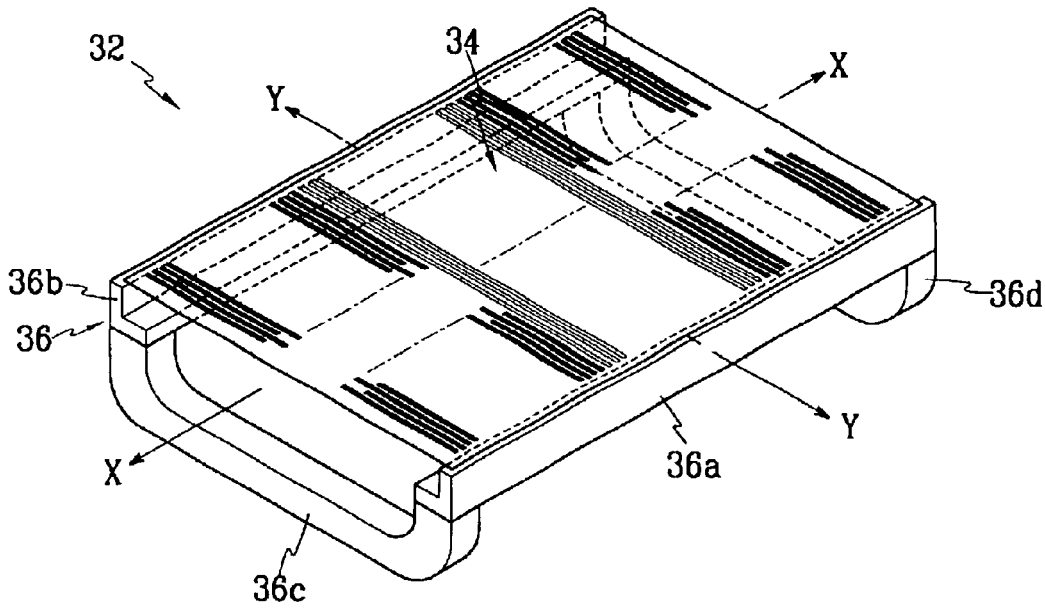
FIG. 2 is a perspective view of a color selection apparatus according to an embodiment of the present invention.

FIG. 2 shows a perspective view of color selection apparatus 32. Color selection apparatus 32 includes mask 34 and frame 36. Mask 34 is formed having a long axis X and a short axis Y (e.g., a rectangle), and frame 36 extends in the directions of the long axis X and the short axis Y of mask 34 and is connected to mask 34 to support the same. In an embodiment of the present invention, frame 36 includes support members 36*a* and 36*b*, and elastic members 36*c* and 36*d*. However, the present invention is not limited to this configuration.

In more detail, support members 36*a* and 36*b* are substantially parallel to and at a predetermined distance from each other. Elastic members 36*c* and 36*d* are connected to support members 36*a* and 36*b*. That is, elastic member 36*c* extends from one end of support member 36*a* to a corresponding end of support member 36*b*, and elastic member 36*d* extends from an opposite end of support member 36*a* to a corresponding end of support member 36*b*. Accordingly, support members 36*a* and 36*b* extend in the direction of the long axis X of mask 34, and elastic members 36*c* and 36*d* extend in the direction of the short axis Y of mask 4. A welding process, for example, is used for the connection of elastic members 36*c* and 36*d* to support members 36*a* and 36*b* such that these elements are formed as a single body. Mask 34 is connected to support members 36*a* and 36*b*.

Figure 3:
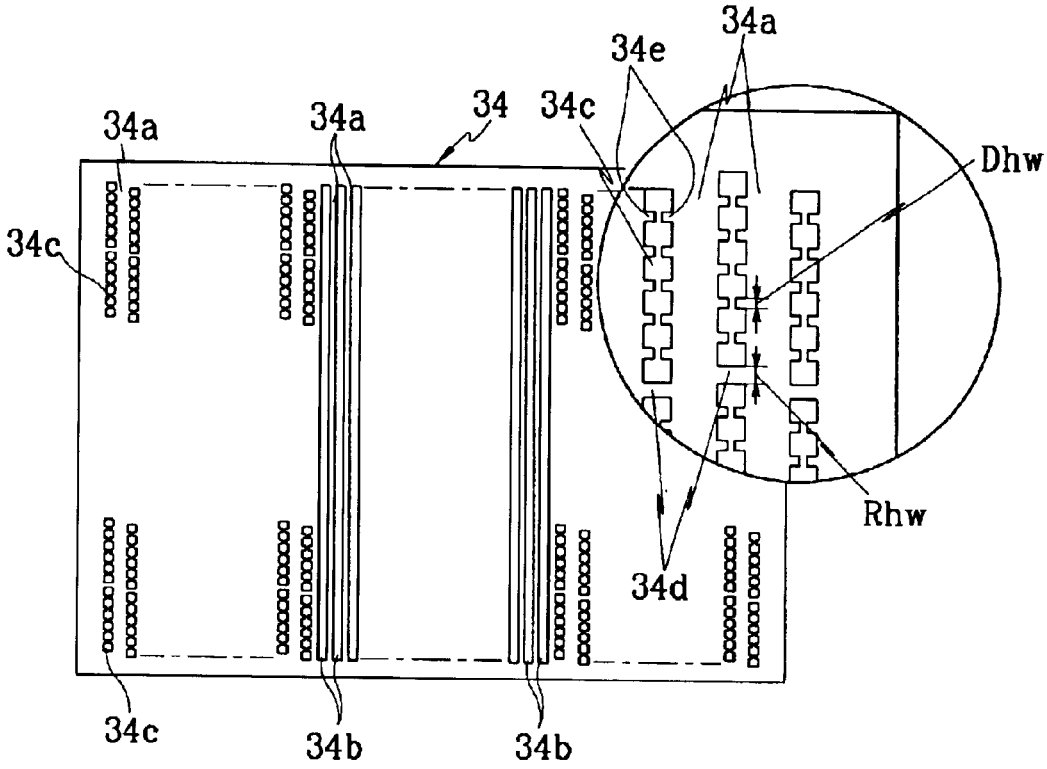
FIG. 3 is a plan view of a mask of a color selection apparatus according to an embodiment of the present invention.
Figure 4:
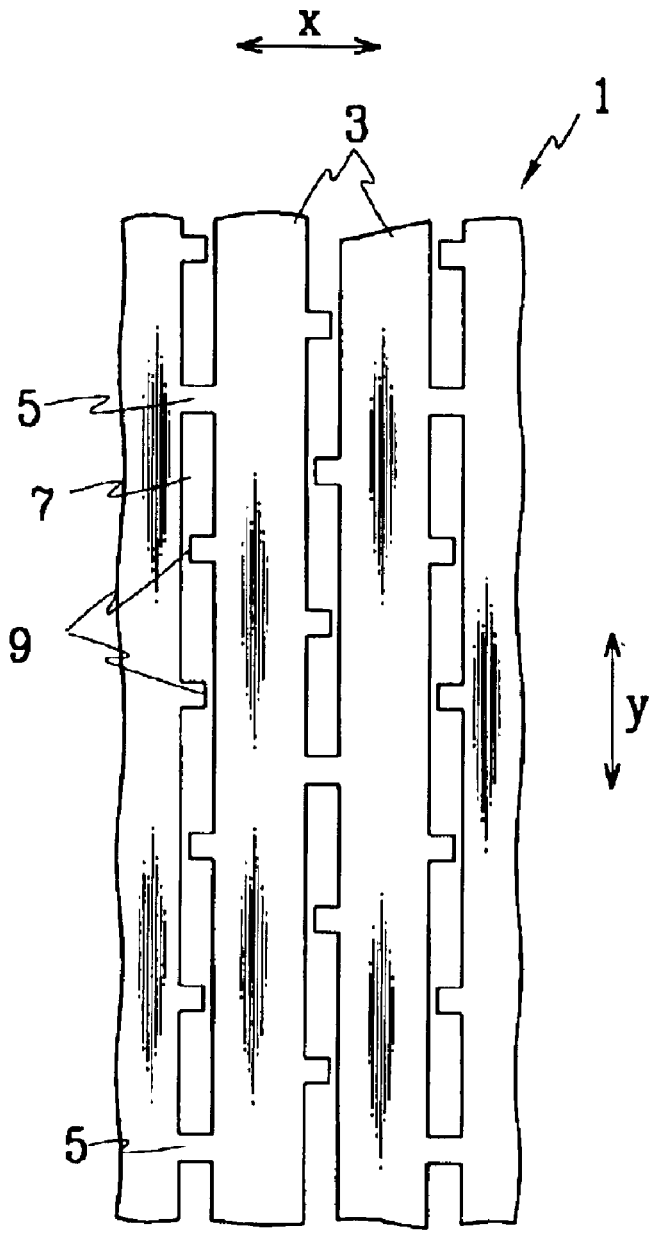
Fig.4(Prior Art)
FIG. 4 is a partial plan view of a mask of a conventional color selection apparatus.

Mask 34 is made of flattened iron (Fe). In more detail, with reference to FIG. 3, mask 34 includes a plurality of strips 34*a* that are provided in the direction of the short axis Y of mask 34 and are separated by a predetermined distance, and a plurality of first and second beam apertures 34*b* and 34*c* formed between strips 34*a*. First beam apertures 34*b* are formed as single, long slits extending in the direction of the short axis Y of mask 34, and second beam apertures 34*c* are formed in a predetermined pattern extending in the direction of the short axis Y of mask 34. In a single column in the direction of the short axis Y of mask 34, second beam apertures 34*c* are divided into a plurality of identically formed, separate units.

The first beam apertures 34*b* are formed in a center portion of mask 34, and second beam apertures 34*c* are formed on both sides of first beam apertures 34*b*. Individual second beam apertures 34*c* are separated within a single column by real bridges 34*d*. Further, a plurality of dummy bridges 34*e* is formed in each individual second beam aperture 34*c*. Dummy bridges 34*e* extend inwardly in the direction of the long axis X of mask 34 but do not extend completely through second beam apertures 34*c*. Accordingly, dummy bridges 34*e* are integrally formed with strips 34*a* between second beam apertures 34*c*. Although the inward formation of dummy bridges 34*e* on one side of second beam apertures 34 corresponds to the inward formation of dummy bridges 34*e* on the opposite side of second beam apertures 34, the present invention is not limited to this configuration.

During operation of the CRT using color selection apparatus 32 with the above structure, the electron beams landing at a center portion of phosphor screen 20 undergo color separation by passing through first beam apertures 34*b*, and the electron beams landing to both sides of the center portion of the phosphor screen undergo color separation by passing through second beam apertures 34*c*. As a result, viewing images created by phosphor screen 20 experience far less reduction in picture quality caused by 'black lines'.

That is, in the case where the CRT is used in a television, the center of screen 20 is viewed more by users than peripheries of screen 20. Since first beam apertures 34*b* are formed in the center portion of mask 34 corresponding to the center of phosphor screen 20, and since first beam apertures 34*b* are void of real bridges 34*b*, which cause the formation of black lines, a significantly improved picture quality is realized.

Further, even with the formation of black lines in the left and right outer areas of phosphor screen 20 (i.e., on both sides of the center portion), since these areas are non-continuous, that is, separated by the center portion of phosphor screen 20, users are less likely to notice the black lines. In other words, compared to black lines running completely across phosphor screen 20 in the direction of the long axis Y of mask 34, the resulting black lines of the present invention that are broken and that do not appear where screen 20 is viewed the majority of the time by users are far less likely to be noticed.

In addition, since second beam apertures 34*c* are separated by real bridges 34*d* into short individual units, vibration of mask 34 caused by external impact is significantly reduced.

It is preferable that mask 34 is structured satisfying the following conditions.

First, with regard to the mounting of mask 34 in tension on frame 36, it is preferable that a tension ($T_1$) applied to strips 34*a* in the area of mask 34 where first beam apertures

34*b* are formed is greater than a tension ($T_2$) applied to strips 34 in the area of mask 34 where the second beam apertures 34*c* are formed. It is more preferable that the tensions $T_1$ and $T_2$ satisfy the following condition:

$$T_2<T_1\leqq 2T_2$$

The satisfaction of this condition ensures a more stable structure. That is, since the area where first beam apertures 34*b* are formed is less resistant to vibration, it is necessary that more tension be applied to this area than to the outer portions of mask 34.

Also, it is preferable that a number of real bridges 34*d* between second beam apertures 34*c* in a single column is increased as the distance from the center portion of mask 34 is increased. This allows for a desired tension to be obtained even with the application of a small tension to the outer portions of mask 34.

In addition, it is preferable that a real bridge height Rhw and a dummy bridge height Dhw (both in the direction of the short axis Y of mask 34) satisfy the following condition:

$$0.5Rhw\leqq Dhw\leqq 2.0Rhw.$$

The real bridge heights Rhw for real bridges 34*d* in a single column may be identical or different. Further, the real bridge heights Rhw and the dummy bridge heights Dhw may be identical or different.

In the color selection apparatus for CRTs of the present invention described above, the beam passage apertures are patterned such that the formation of black lines on the phosphor screen and the ability of users to perceive the black lines are minimized, thereby improving picture quality.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A color selection apparatus comprising:

a mask formed having a first axis and a second axis; and a frame supporting the mask in one of a first axis direction and a second axis direction, the mask including:

a plurality of strips separated by a predetermined distance;

a plurality of first beam apertures formed as tingle second axis direction slits between the strips in a center portion of the mask;

a plurality of second beam apertures formed on outer portions of the mask on both sides of the center portion of the mask, the second beam apertures being divided into a plurality of individual second beam aperture units within a second axis direction single column by real bridges; and at least one dummy bridge for each individual second beam aperture unit, the at least one dummy bridge extending inwardly from the strips but not crossing completely through the individual second beam aperture unit.

2. The color selection apparatus of claim 1, wherein a tension $T_1$ applied to the strips in the area of the mask where the first beam apertures are formed is greater than a tension $T_2$ applied to the strips in the area of the mask where the second beam apertures are formed.

3. The color selection apparatus of claim 2, wherein the tensions $T_1$ and $T_2$ satisfy the following condition:

$$T_2<T_1<2T_2.$$

4. The color selection apparatus of claim 1, wherein the number of real bridges being formed between the second beam apertures in a single column is increased as a distance from the center portion of the mask is increased.

5. The color selection apparatus of claim 1, wherein a real bridge height Rhw and a dummy bridge height Dhw are both in the second axis direction of the mask, and satisfy the following condition:

$$0.5Rhw<Dhw<2.0Rhw.$$

6. The color selection apparatus of claim 1, wherein the dummy bridges are formed from the strips in the first axis a direction of the mask.

7. The color selection apparatus of claim 6, wherein the dummy bridges formed on one side of the second beam apertures correspond to the dummy bridges formed on an opposite side of the second beam apertures.

8. A color selection apparatus comprising:

a mask formed having a first axis and a second axis; and a frame supporting the mask in one of a first axis direction and a second axis direction, the mask including:

a plurality of strips separated by a predetermined distance;

a plurality of first beam apertures formed as single second axis direction slits between the strips in a center portion of the mask;

a plurality of second beam apertures formed on outer portions of the mask on both sides of the center portion of the mask, the second beam apertures being divided into a plurality of individual second beam aperture units within a second axis direction single column by real bridges, the number of real bridges formed between the second beam apertures in a single column being increased as a distance from the center portion of the mask is increased; and at least one dummy bridge for each individual second beam aperture unit, the at least one dummy bridge:

extending inwardly from the strips but not crossing completely through the individual second beam aperture unit, being formed from the strips in the first ands a direction of the mask, and being formed on one side of the individual second beam apertures corresponding to a dummy bridge formed on an opposite side of the individual second beam aperture unit;

wherein a tension TX applied to the strips in the area of the mask where the first beam apertures are formed is greater than a tension $T_2$ applied to the strips in the area of the mask where the second beam apertures are formed and the tensions $T_1$ and $T_2$ satisfy the following condition:

$$T_2<T_1<2T_2$$

and wherein a real bridge height Rhw and a dummy bridge height Dhw, are both in the second axis a direction of the mask, and satisfy the following condition:

$$0.5Rhw<Dhw<2.0Rhw.$$

* * * * *